US011149673B2

(12) United States Patent
Yamane et al.

(10) Patent No.: US 11,149,673 B2
(45) Date of Patent: Oct. 19, 2021

(54) CONTROL DEVICE FOR INTERNAL COMBUSTION ENGINE

(71) Applicant: Yanmar Co. Ltd., Osaka (JP)

(72) Inventors: Hironori Yamane, Osaka (JP); Katsunari Jonouchi, Osaka (JP)

(73) Assignee: Yanmar Power Technology Co., Ltd., Osaka (JP)

( * ) Notice: Subject to any disclaimer, the term of this patent is extended or adjusted under 35 U.S.C. 154(b) by 0 days.

(21) Appl. No.: 16/652,988

(22) PCT Filed: Aug. 15, 2018

(86) PCT No.: PCT/JP2018/030334
§ 371 (c)(1),
(2) Date: Apr. 2, 2020

(87) PCT Pub. No.: WO2019/087521
PCT Pub. Date: May 9, 2019

(65) Prior Publication Data

US 2020/0263625 A1 Aug. 20, 2020

(30) Foreign Application Priority Data

Oct. 30, 2017 (JP) ..... JP2017-209441

(51) Int. Cl.
*F02D 41/22* (2006.01)
*F02D 41/24* (2006.01)
*F02M 26/49* (2016.01)

(52) U.S. Cl.
CPC ..... *F02D 41/2432* (2013.01); *F02D 41/22* (2013.01); *F02D 41/2441* (2013.01); *F02D 41/2474* (2013.01); *F02M 26/49* (2016.02)

(58) Field of Classification Search
CPC ... F02D 41/2432; F02D 41/22; F02D 41/2474
See application file for complete search history.

(56) References Cited

U.S. PATENT DOCUMENTS 4,522,176 A * 6/1985 Takao ..... F02D 31/005 123/339.24
5,906,184 A * 5/1999 Maruyama ..... F02D 41/22 123/339.15

(Continued)

*Primary Examiner* — Thomas N Moulis
(74) *Attorney, Agent, or Firm* — Chris Mizumoto

(57) ABSTRACT

An ECU includes a cooling water temperature sensor, an intake air temperature sensor, a storage unit, a determination unit, and a calibration unit. In an after-run control performed after the internal combustion engine stops, the determination unit compares a cooling water temperature Tw detected by the cooling water temperature sensor with a first threshold value T1 and determines that the environment is not the cold environment in which an EGR differential pressure sensor is likely to be frozen, if the cooling water temperature Tw is equal to or higher than the first threshold value T1, or if the cooling water temperature Tw is less than the first threshold value T1 but is equal to or higher than a second threshold value T2 which is lower than the first threshold value T1 and an intake air temperature Ta from the intake air temperature sensor is equal to or higher than a third threshold value T3, and determines that the environment is the cold environment otherwise. When the environment is determined as not to be the cold environment, the calibration unit obtains a calibration reference value based on the detection value from the EGR differential pressure sensor. The storage unit stores the calibration reference value obtained by the calibration unit.

2 Claims, 4 Drawing Sheets

(56) References Cited

U.S. PATENT DOCUMENTS

| | | | | |
|---|---|---|---|---|
| 2003/0046990 | A1* | 3/2003 | Joos | F02D 41/3836<br>73/114.44 |
| 2008/0196700 | A1* | 8/2008 | Chyo | F02M 31/20<br>123/541 |
| 2009/0112451 | A1* | 4/2009 | Justice | G01M 15/042<br>701/115 |
| 2017/0370314 | A1* | 12/2017 | Ito | F01P 3/20 |

* cited by examiner

CONTROL DEVICE FOR INTERNAL COMBUSTION ENGINE

CROSS-REFERENCE

This application is a national phase of an international application, PCT/JP2018/030334 filed on Aug. 15, 2018, which claims the benefit of Japanese Application No. 2017-209441 filed on Oct. 30, 2017.

TECHNICAL FIELD

The present invention relates to a control device for an internal combustion engine, which calibrates a pressure sensor.

BACKGROUND ART

Traditionally, there has been a known structure that calibrates a pressure sensor in an internal combustion engine, for a purpose of correcting an influence on the output of the pressure sensor due to a change over time. Patent Literature 1 (hereinafter, PTL 1) discloses a pressure measuring device of such a type.

The pressure measuring device of PTL 1 is configured to store, as a learning value of a zero-point learning, an output value of a pressure sensor, when a drop in the output of the pressure sensor is stabilized after stopping of the internal combustion engine.

Although Patent Literature 2 (hereinafter, PTL 2) does not mention calibration of the pressure sensor, it discloses a control device for a diesel engine configured to use an intake air temperature and a cooling water temperature to determine whether a throttle valve thereof is frozen.

CITATION LIST

Patent Literature

PTL 1: Japanese Patent Application Laid-Open No. 2013-125023

PTL 2: Japanese Patent Application Laid-Open No. 2016-156301

SUMMARY OF INVENTION

Technical Problem

However, the configuration of the PTL 1 does not take into account a case of obtaining a calibration reference value when freezing occurs to the pressure sensor, particularly during winter in a cold region.

Meanwhile, the calibration of PTL 2 always uses both the intake air temperature and the cooling water temperature to determine whether the throttle valve is frozen, the process of determination is not necessarily simple.

The present invention is made in view of the above circumstances, and it is an object of the present invention to provide a control device for an internal combustion engine with a simple process of determination, the control device configured to obtain a calibration reference value in consideration of freezing taking place inside the pressure sensor.

Solution to Problem and Advantages

Problems to be solved by the invention are as described above, and next, means for solving the problems and effects thereof will be described.

In an aspect of the present invention, a control device for an internal combustion engine having the following configuration is provided. Namely, the control device for the internal combustion engine calibrates a detected value from a pressure detection unit of the internal combustion engine, during operation of the internal combustion engine. The control device for the internal combustion engine includes a cooling water temperature detection unit, an intake air temperature detection unit, a storage unit, a determination unit, and a calibration unit. The cooling water temperature detection unit is configured to detect a cooling water temperature of the internal combustion engine. The intake air temperature detection unit is configured to detect an intake air temperature of the internal combustion engine. The storage unit stores a calibration reference value for calibrating the detection value from the pressure detection unit. The determination unit determines whether an environment is a cold environment in which the pressure detection unit is likely to freeze. The calibration unit obtains the calibration reference value. In an after-run control performed after the internal combustion engine stops, the determination unit compares a cooling water temperature detected by the cooling water temperature detection unit with a first threshold value and determines that the environment is not the cold environment if the cooling water temperature is equal to or higher than the first threshold. If, as a result of the comparison, the cooling water temperature detected by the cooling water temperature detection unit is less than the first threshold value; the determination unit determines that the environment is not the cold environment if the cooling water temperature is equal to or higher than a second threshold value lower than the first threshold value and the intake air temperature is equal to or higher than a third threshold value, and otherwise, determines that the environment is the cold environment. The calibration unit obtains a calibration reference value based on the detection value from the pressure detection unit when the determination unit determines that the environment is not the cold environment. The storage unit stores the calibration reference value obtained by the calibration unit.

With this, the calibration reference value can be obtained immediately after the internal combustion engine stops, in a situation where freezing of the pressure detection unit is highly unlikely. On the other hand, for example, when the internal combustion engine is stopped very soon after it is started, there is a possibility of the pressure detection unit being frozen. Therefore, by determining whether or not the environment is a cold environment, obtaining of the calibration reference value while the pressure detection unit is frozen can be suppressed or reduced. Further, the process of comparing the cooling water temperature with the threshold values is performed in advance, the process of determining whether the environment is a cold environment is simplified. Therefore, sufficiency in the frequency of obtaining calibration reference value can be achieved.

The control device for the internal combustion engine is preferably configured as follows. Namely, when the cooling water temperature detected by the cooling water temperature detection unit within a period after powering on and before start of the internal combustion engine is equal to or higher than a fourth threshold value, the calibration unit obtains the calibration reference value based on a detection value detected by the pressure detection unit within the period after powering on and before start of the internal combustion engine, and uses the calibration reference value thus obtained to calibrate detection values of the pressure detection unit after start of the internal combustion engine. When the cooling water temperature is less than the fourth threshold value, the calibration unit uses the calibration reference value stored in the storage unit, to calibrate detection values of the pressure detection unit after start of the internal combustion engine.

With this, when it is clearly determined that no freezing is taking place in the pressure detection unit, a detection value detected by using the pressure detection unit can be used in calibration, reflecting the current status of the pressure detection unit. If this is not the case, the calibration reference value stored in the storage unit is used, so that calibration while freezing is taking place can be avoided.

DESCRIPTION OF EMBODIMENTS

Figure 1:
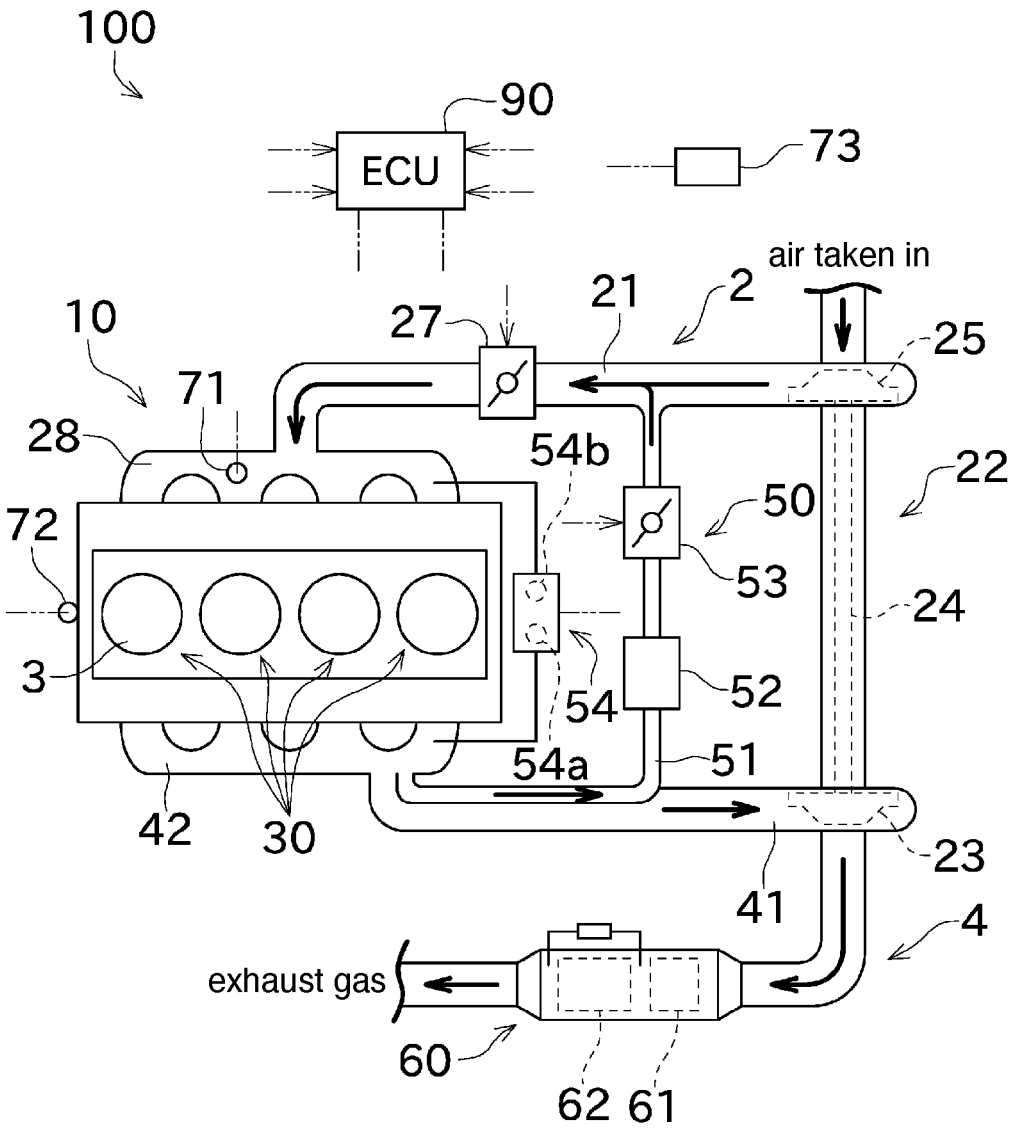
FIG. 1 An explanatory diagram schematically showing a flow of air taken in and exhaust gas in an internal combustion engine related to one embodiment of the present invention.

Next, an embodiment of the present invention will be described with reference to the drawings. FIG. 1 is an explanatory diagram schematically showing a flow of air taken in and exhaust gas in an internal combustion engine 100 related to one embodiment of the present invention.

The internal combustion engine 100 shown in FIG. 1 is a diesel engine, which is configured as a serial four cylinder engine having four cylinders 30. The internal combustion engine 100 essentially includes an engine body 10 and an ECU (Engine Control Unit) 90 serving as a control device.

The engine main body 10 includes, as main parts, an air-intake unit 2 configured to take in air from the outside, cylinders 3 each having a not-shown combustion chamber, and an exhaust unit 4 configured to discharge exhaust gas generated by combustion of a fuel in the combustion chamber 3 to the outside.

The air-intake unit 2 includes an air-intake pipe 21 which is a passage for the air taken in. The air-intake unit 2 includes a turbocharger 22, a throttle valve 27, and an air-intake manifold 28 which are arranged in this order from the upstream side relative to the direction in which the intake air flows in the air-intake pipe 21.

The air-intake pipe 21 is a passage of the air taken in, and connects the turbocharger 22, the throttle valve 27, and the air-intake manifold 28. The air taken in from the outside can flow inside the air-intake pipe 21.

As shown in FIG. 1, the turbocharger 22 has a turbine 23, a shaft 24, and a compressor 25. The compressor 25 is coupled to the turbine 23 through the shaft 24. The turbine 23 rotates with the exhaust gas, and with this rotation, the compressor 25 rotates. This compresses and forcedly sucks in the air cleaned by a not-shown air cleaner.

The throttle valve 27 adjusts its opening degree according to a control command from the ECU 90 thereby changing the cross-sectional area of the passage for the air taken in. Thus, the amount of air supplied to the air-intake manifold 28 can be adjusted through the throttle valve 27.

The air-intake manifold 28 can distribute the air supplied through the air-intake pipe 21, according to the number of cylinders of the engine body 10, thereby supplying the air to the combustion chamber 3 of each cylinder.

The air-intake manifold 28 has an intake air temperature sensor (intake air temperature detection unit) 71. An intake air temperature Ta detected by the intake air temperature sensor 71 is output to the ECU 90. It should be noted that the position of arranging the intake air temperature sensor 71 is not limited to the air-intake manifold 28, and for example, may be in the intake air passage on the upstream side of the air-intake manifold 28.

In the combustion chamber 3, the air supplied through the air-intake manifold 28 is compressed, and a fuel is injected into the compressed air whose temperature has risen. This spontaneously ignites the fuel and pushes the piston to move. The power thus obtained is transmitted to a suitable device on a power-downstream side through a not-shown crankshaft and the like.

The internal combustion engine 100 of the present embodiment has a not-shown cooling water circulation system. This cooling water circulation system is configured to recirculate the cooling water to a cooling jacket formed in a cylinder head or the like of the engine body 10, to cause heat exchanging for cooling.

In a suitable position of a cooling water path in the cooling water circulation system, a cooling water temperature sensor (cooling water temperature detection unit) 72 for detecting a cooling water temperature Tw is arranged. The cooling water temperature Tw detected by the cooling water temperature sensor 72 is output to the ECU 90.

Further, the internal combustion engine 100 of the present embodiment includes an atmospheric pressure sensor 73 configured to detect an atmospheric pressure of the surroundings. For example, the atmospheric pressure sensor 73 can be provided nearby the ECU 90. The position of arranging the atmospheric pressure sensor 73 can be any position provided that it can detect the atmospheric pressure.

The exhaust gas generated by combusting the fuel in the combustion chamber 3 is discharged from the combustion chamber 3 to the outside the engine body 10, through the exhaust unit 4.

The exhaust unit 4 includes an exhaust pipe 41 which is a passage for the exhaust gas. Further, the exhaust unit 4 includes an exhaust gas manifold 42 and a DPF (Diesel Particulate Filter) 60 serving as an exhaust gas purification device, which are arranged in this order from the upstream side relative to the direction in which the exhaust gas flows in the exhaust pipe 41.

The exhaust pipe 41 serves as a passage for the exhaust gas and connects the exhaust gas manifold 42 and the DPF 60. The exhaust gas discharged from the combustion chamber 3 can flow inside the exhaust pipe 41.

The exhaust gas manifold 42 collects the exhaust gas generated in each combustion chamber 3 and guides the exhaust gas to the exhaust pipe 41 so as to supply the exhaust gas to the turbine 23 of the turbocharger 22.

The DPF 60 serves as an exhaust gas purification device, and includes an oxidation catalyst 61 and a soot filter 62 for removing harmful components or particulate matters in the exhaust gas. Harmful components such as nitrogen monoxide, carbon monoxide, and the like contained in the exhaust gas are oxidized by the oxidation catalyst 61. Further, particulate matters contained in the exhaust gas are collected by the soot filter 62 and are oxidized in the soot filter 62. As described, the exhaust gas is purified through the DPF 60.

Further, the engine body 10 includes an EGR (Exhaust Gas Recirculation) device 50 and can recirculate part of the exhaust gas to the air-intake side through the EGR device 50, as shown in FIG. 1.

The EGR device 50 includes an EGR pipe 51, an EGR cooler 52, an EGR valve 53, and an EGR differential pressure sensor 54.

The EGR pipe 51 is a passage for guiding EGR gas, which is the exhaust gas recirculated to the air-intake side, to the air-intake pipe 21, and is arranged in such a manner as to communicate the exhaust pipe 41 with the air-intake pipe 21.

The EGR cooler 52 is arranged in a midway portion of the EGR pipe 51 and cools the EGR gas to be recirculated to the air-intake side.

The EGR valve 53 is arranged in a midway portion of the EGR pipe 51 on the downstream side of the EGR cooler 52 relative to an EGR gas recirculating direction and can adjust the amount of EGR gas recirculated. The EGR valve 53 adjusts its opening degree according to a control signal from the ECU 90, thereby adjusting the area of recirculation passage for the EGR gas. This way, the amount of EGR gas recirculated can be adjusted.

The EGR differential pressure sensor 54 is for detecting the differential pressure between an intake pressure which is a pressure of intake air and an exhaust pressure which is a pressure of the exhaust gas. The EGR differential pressure sensor 54 introduces the intake pressure from the air-intake manifold 28 and introduces the exhaust pressure from the exhaust gas manifold 42.

As shown in FIG. 1, the EGR differential pressure sensor 54 includes an exhaust side detection sensor 54*a* configured to detect the exhaust pressure introduced, and an intake pressure detection sensor 54*b* configured to detect the intake pressure introduced. In the present embodiment, these two detection sensors 54*a* and 54*b* correspond to the pressure detection unit. The EGR differential pressure sensor 54 obtains a differential pressure between the intake pressure and the exhaust pressure based on the detection values of the two detection sensors 54*a* and 54*b*.

The two detection sensors 54*a* and 54*b* output electric signals according to the pressures. To improve the accuracy of measurement, each of the detection sensors 54*a* and 54*b* performs detection in advance under the atmospheric pressure. Then, a value based on an electric signal at this time is stored as a correction value (a calibration reference value).

The atmospheric pressure varies depending on the environment and the like. Given this, in the present embodiment, instead of the values indicated by the electric signals from the detection sensors 54*a* and 54*b*, these values are each converted so that the atmospheric pressure detected by the atmospheric pressure sensor 73 at that time is the reference, and the value thus converted is stored as a correction value.

During a normal measurement, the correction value stored is read out, and conversion is carried out so that the atmospheric pressure detected by the atmospheric pressure sensor 73 is the reference. Then the value indicated by the electric signal from each of the detection sensors 54*a* and 54*b* is calculated such that the value is zero when it is equal to the value resulting from the above addition, and a value resulting from this calculation serves as a detection value. This calculation essentially corresponds to the zero point adjustment (calibration) of the detection value.

Therefore, the detection value of each of the detection sensors 54*a* and 54*b* is zero, when it is a pressure that corresponds to the atmospheric pressure. A difference between the detection values from the two detection sensors 54*a* and 54*b* is a detection value of the EGR differential pressure sensor 54.

The ECU 90 controls the opening degree of the EGR valve 53 based on the differential pressure obtained based on the detection value from the EGR differential pressure sensor 54, and an amount of recirculation of the EGR gas calculated according to an operation status of the internal combustion engine 100.

Figure 2:
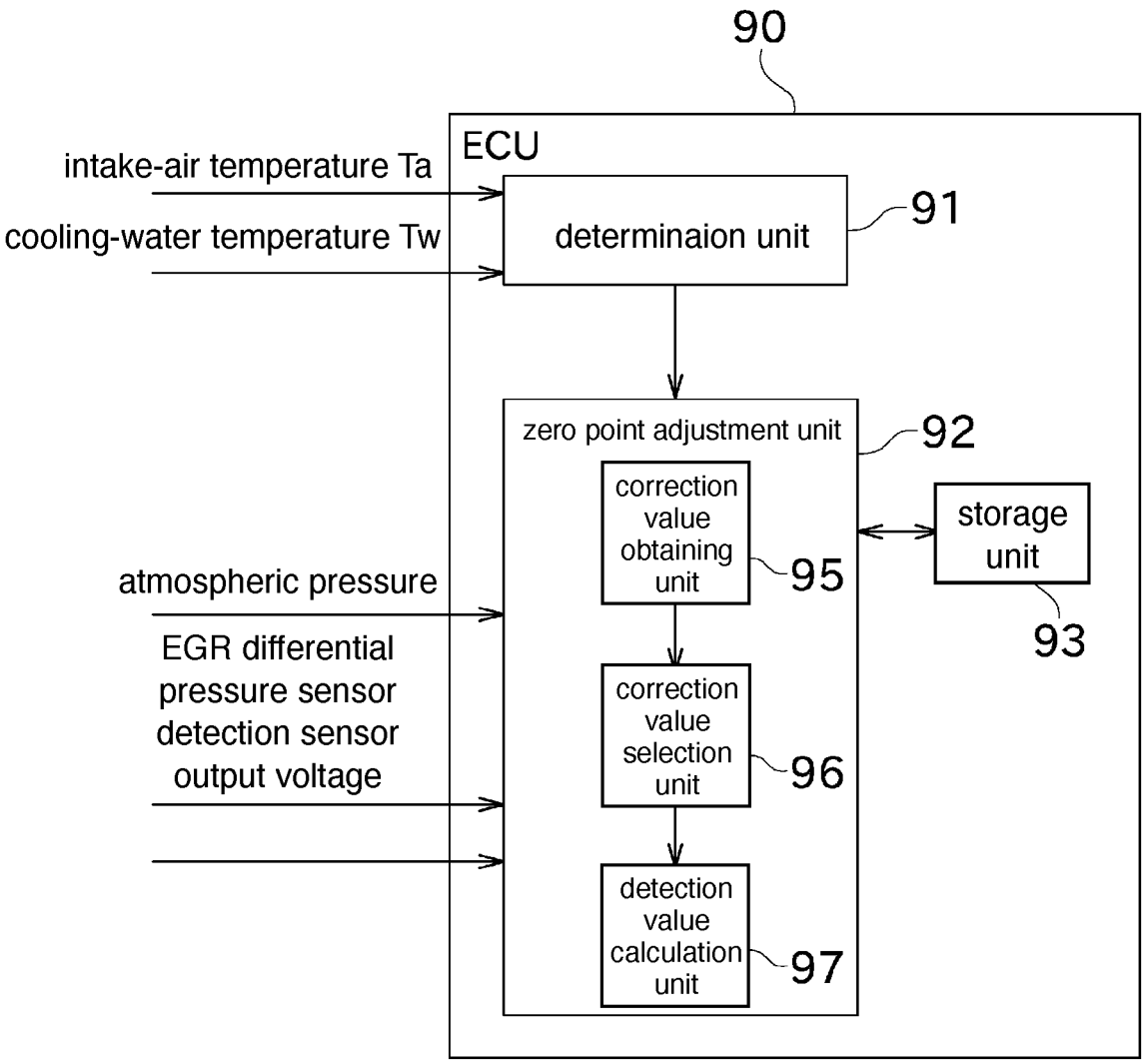
FIG. 2 A block diagram showing a configuration of obtaining correction values for calibrating an EGR differential pressure sensor in the ECU.
Figure 3:
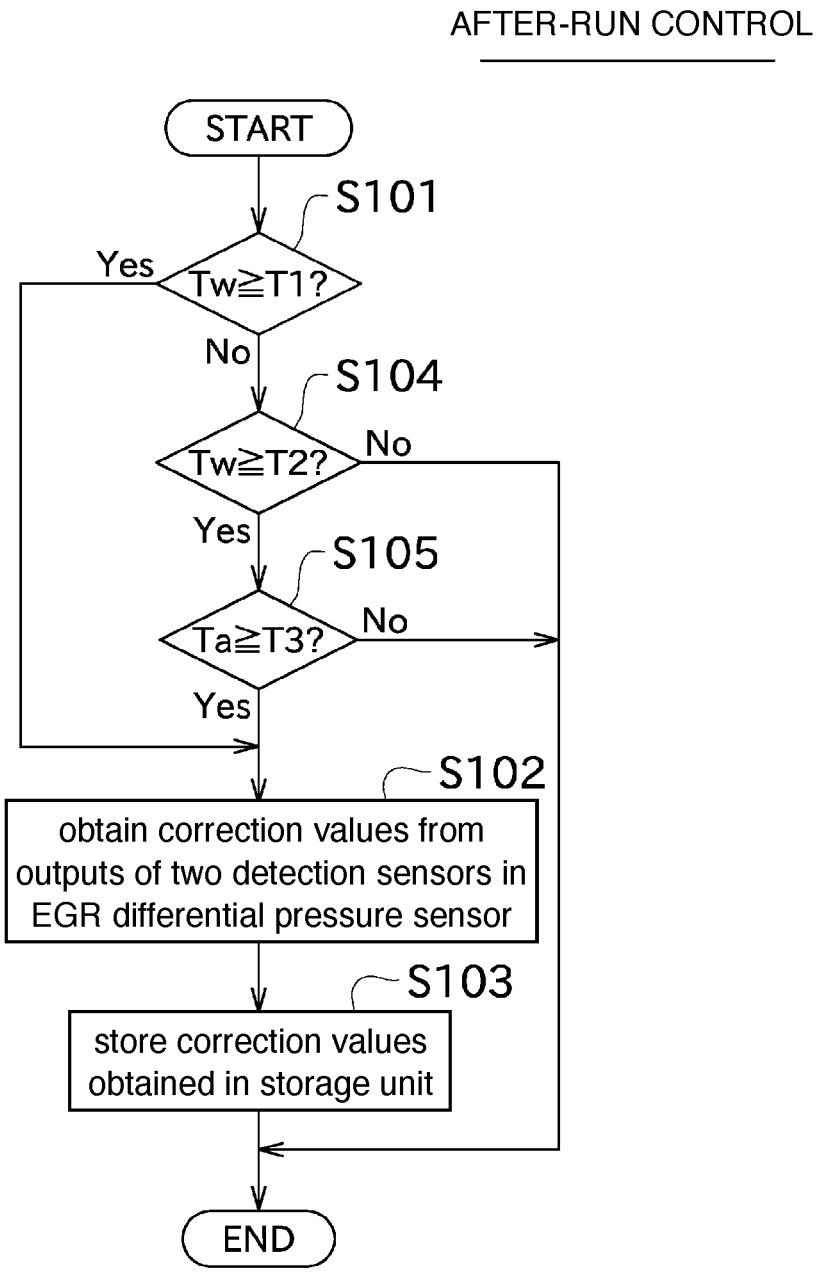
FIG. 3 A flowchart used in a process of obtaining the correction values in an after-run control.
Figure 4:
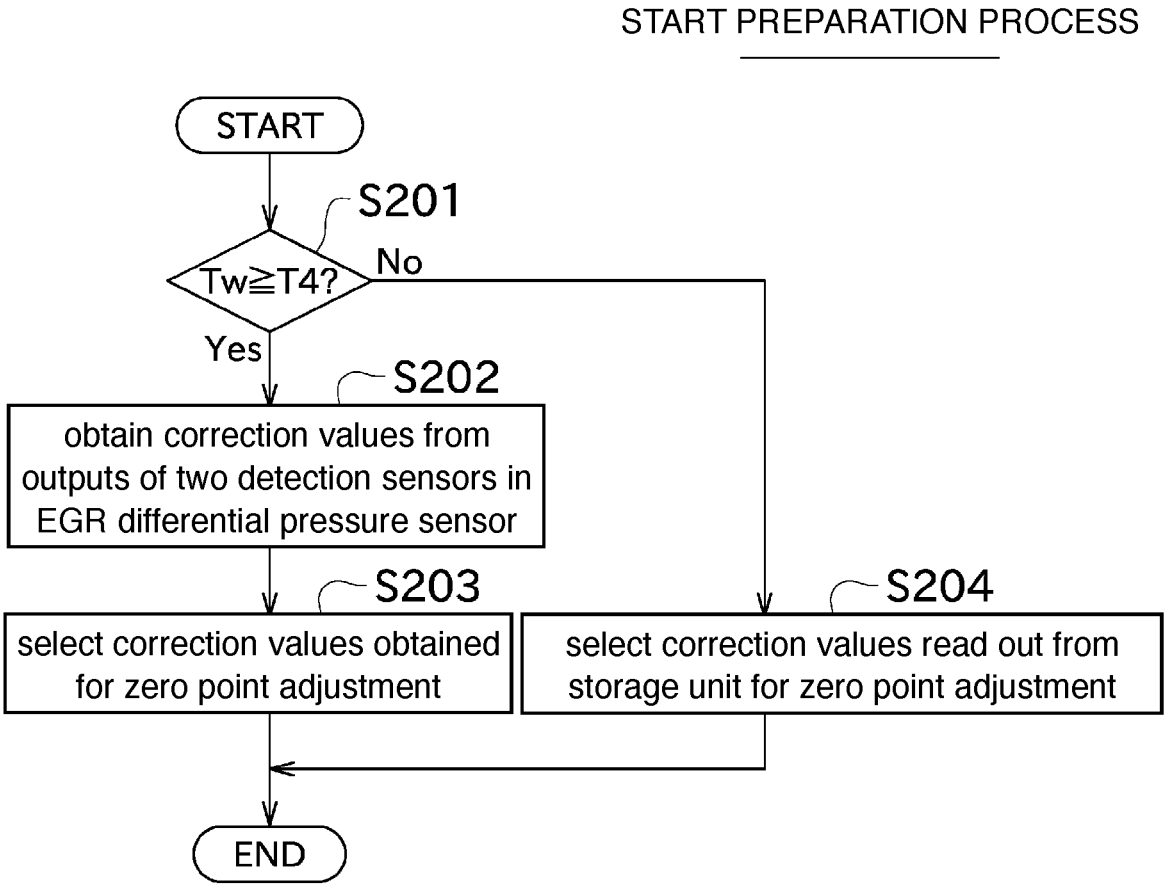
FIG. 4 A flowchart used in a process of obtaining the correction values within a period after powering on and before start of the internal combustion engine.

The following describes with reference to FIG. 2 to FIG. 4 how the correction value for use in calibration of the EGR differential pressure sensor 54 is obtained.

FIG. 2 is a block diagram showing a configuration that obtains a correction value of the EGR differential pressure sensor in the ECU. FIG. 3 is a flowchart used in a process of obtaining the correction value in an after-run control. FIG. 4 is a flowchart used in the process of obtaining the correction values within a period after powering on and before start of the internal combustion engine.

The ECU 90 of the present embodiment is arranged in or nearby the engine body 10, and includes a determination unit 91, a zero point adjustment unit (calibration unit) 92, and a storage unit 93, as shown in FIG. 2. The ECU 90 is configured as a known computer, and includes a CPU that executes various computation processes and controls, a ROM, a RAM, and the like which store data and the like.

The ECU 90 includes various sensors for detecting the operational state of the engine body 10. Examples of these sensors include the above-described intake air temperature sensor 71, the cooling water temperature sensor 72, the atmospheric pressure sensor 73, and the like. The ECU 90 uses detection results from these sensors to control the operation of the engine body 10.

The determination unit 91 compares at least the cooling water temperature Tw with a threshold value set in advance to determine whether the environment is such that freezing is likely to take place in or around the detection sensors 54*a* and 54*b* of the EGR differential pressure sensor 54.

The zero point adjustment unit 92 includes a correction value obtaining unit (calibration reference value obtaining unit) 95, a correction value selection unit 96, and a detection value calculation unit 97.

The correction value obtaining unit 95 obtains a correction value through a calculation, based on pressures indicated by electric signals from the two detection sensors 54*a* and 54*b* of the EGR differential pressure sensor 54 while the internal combustion engine 100 is stopped (in other words, while the surroundings of the detection sensors 54*a* and 54*b* are under the atmospheric pressure), and the atmospheric pressure detected by the atmospheric pressure sensor 73.

The correction value selection unit 96 selects, as the correction value to be used for the detection value calculation unit 97 to actually calculate the detection value, a correction value stored in the storage unit 93 which is obtained in the past by the correction value obtaining unit 95, or a correction value obtained at the site by the correction value obtaining unit 95.

During operation of the internal combustion engine 100, the detection value calculation unit 97 performs the zero point adjustment to the pressures indicated by the electric signals from the two detection sensors 54*a* and 54*b* of the EGR differential pressure sensor 54, based on the above correction values, thereby calculating detection values. Further, the detection value calculation unit 97 calculates a differential pressure between the intake pressure and the exhaust pressure, based on the detection values from the two detection sensors 54*a* and 54*b*. The differential pressure thus obtained is output for controlling the amount of EGR gas to be recirculated.

The storage unit 93 includes a non-volatile memory that can be rewritten. This non-volatile memory can store correction values obtained by the correction value obtaining unit 95.

Next, the following describes a case where the zero point adjustment of the EGR differential pressure sensor 54 becomes abnormal when the internal combustion engine 100 is operated in a cold region.

When the internal combustion engine 100 is left stopped in a cold region for a long time, the detection sensors 54*a* and 54*b* of the EGR differential pressure sensor 54 or their surroundings may freeze and a proper correction value cannot be obtained. This is particularly true in the exhaust side detection sensor 54*a*, because the exhaust gas contains water vapor generated by combustion, and this water vapor is condensed to water and likely to be frozen.

Specifically, the surroundings of the detection sensors 54*a* and 54*b* may not be the atmospheric pressure, due to ice covering detection elements of the detection sensors 54*a* and 54*b* or ice clogging an air passage communicating to the detection sensors 54*a* and 54*b*. Such a phenomenon may be hereinafter referred to as freezing.

Performing the zero point adjustment using a correction value obtained under a circumstance where the freezing takes place, the detection value of the EGR differential pressure sensor 54 becomes abnormal.

Given this, the ECU 90 of the internal combustion engine 100 of the present embodiment performs a process as described hereinbelow to avoid an inappropriate zero point adjustment. The following describes, with reference to FIG. 3 and FIG. 4, a specific process performed by the ECU 90.

The flow of FIG. 3 shows a process related to obtaining of a correction value, in an after-run performed after the rotation of the internal combustion engine 100 is stopped and before the ECU 90 is powered off.

When the flow of FIG. 3 starts, the determination unit 91 of ECU 90 compares the cooling water temperature Tw obtained from the coolant temperature sensor 72 with a first threshold value T1 (step S101). This first threshold value T1 is a temperature of the cooling water such that no freezing is clearly considered as to take place. For example, the first threshold value T1 can be a suitable temperature in a range from 40° C. or higher but not higher than 60° C.

As a result of the comparison in step S101, if the cooling water temperature Tw is equal to or higher than the first threshold value T1, it can be thought that there is no freezing in the two detection sensors 54*a* and 54*b* of the EGR differential pressure sensor 54. Thus, in this case, the correction value obtaining unit 95 subtract the value of the atmospheric pressure detected by the atmospheric pressure sensor 73 from the values indicated by the electric signals from the two detection sensors 54*a* and 54*b* under the atmospheric pressure, and obtains the values resulting from the subtraction as the correction values (step S102). Then, the correction value obtaining unit 95 stores the correction values obtained in the storage unit 93 (step S103), and terminates the process.

Regarding the environment surrounding the detection sensors 54*a* and 54*b*, an environment such that freezing due to low temperatures is suspected may be referred to as a cold environment in the following description. Therefore, step S101 described above can be rephrased that the determination unit 91 determines whether the environment is a cold environment based on the cooling water temperature Tw.

Meanwhile, as a result of comparison in step S101, if the cooling water temperature Tw is less than the first threshold value T1, the determination unit 91 compares the cooling water temperature Tw with a second threshold value T2 (step S104). The second threshold value T2 can be a suitable temperature in a range of, for example, 5° C. or higher but not higher than 10° C.

A situation where the cooling water temperature Tw is less than the second threshold value T2 as a result of comparison in step S104 can be, for example, a case where the internal combustion engine 100 is started and stopped immediately after in a morning of a cold region. That is, warming up of the engine is likely insufficient and the freezing in the detection sensors 54*a* and 54*b* is not solved yet. This, in other words, can be thought that the current environment is still a cold environment. The correction values are not obtained in the after-run of this case, and the flow is terminated.

On the other hand, if the cooling water temperature Tw is equal to or higher than the second threshold value T2 as a result of the comparison in step S104, it is difficult to determine whether or not the environment is the cold environment, only with the cooling water temperature Tw. To address this, the determination unit 91 compares the intake air temperature Ta detected by the intake air temperature sensor 71 with a third threshold value T3 (step S105). The third threshold value T3 can be a suitable temperature in a range of, for example, 5° C. or higher but not higher than 20° C.

As a result of comparison in step S105, if the intake air temperature Ta is equal to or higher than the third threshold value T3, it can be thought that the two detection sensors 54*a* and 54*b* are not frozen (in other words, not in a cold environment). In this case, therefore, the correction values are obtained and stored as is described hereinabove (step S102 and step S103).

On the other hand, if the intake air temperature Ta is less than the third threshold value T3 as a result of comparison in step S105, it is highly unlikely that the freezing in the detection sensors 54*a* and 54*b* is solved. This, in other words, can be said that the current environment is the cold environment. In this case, therefore, the correction value is not obtained in this after-run, and execution of the flow is terminated.

The flow of FIG. 4 shows a process of selecting the correction values to be used, which is performed when the power of the ECU 90 is switched from the OFF state to the ON state.

When the flow of FIG. 4 starts, the determination unit 91 compares the cooling water temperature Tw obtained from the coolant temperature sensor 72 with a fourth threshold value T4 (step S201). As is the case of the above-described first threshold value T1, the fourth threshold value T4 can be a suitable temperature in a range of, for example, 40° C. or higher but not higher than 60° C.

As a result of the comparison in step S201, if the cooling water temperature Tw is equal to or higher than the fourth threshold value T4, it can be thought that there is no freezing in the two detection sensors 54*a* and 54*b*, and there is no problem in obtaining the correction values now. In other words, it can be considered that the environment is not a cold environment. In view of this, the correction value obtaining unit 95 obtains the correction values based on the outputs from the detection sensors 54*a* and 54*b* as in step S102 of FIG. 3 (step S202). Then, the correction value selection unit 96 selects the correction values obtained in step S202 as the correction values used for the zero point adjustment (step S203).

On the other hand, if the cooling water temperature Tw is less than the fourth threshold value T4, there is a chance of freezing currently taking place in the detection sensors 54*a* and 54*b*. Therefore, the correction value selection unit 96 selects correction values retrieved from the storage unit 93 as the correction values to be used for the zero point adjustment (step S204).

The correction values selected by either step S203 or step S204 are used for the detection value calculation unit 97 shown in FIG. 2 to obtain detection values from electric signals of the detection sensors 54*a* and 54*b*, after the internal combustion engine 100 is started.

As hereinabove mentioned, freezing may take place in the detection sensors 54*a* and 54*b* of the EGR differential pressure sensor 54. However, the freezing of the detection sensors 54*a* and 54*b* is less likely to take place immediately after the internal combustion engine 100 is stopped, as compared to a case of leaving the detection sensors 54*a* and 54*b* for a long time after the stopping of the internal combustion engine 100.

Therefore, in principle, the correction values are obtained based on the outputs from the detection sensors 54*a* and 54*b* during the after-run in the present embodiment. The values are then stored and used in the zero point adjustment, after re-starting of the engine.

This way, inappropriate zero point adjustment can be suppressed or reduced, and an occurrence of abnormality in the output values of the EGR differential pressure sensor 54 after the starting of the engine can be avoided.

However, there is no guarantee that freezing never takes place during the after-run. For this reason, in the present embodiment, the determination unit 91 determines whether the environment is a cold environment during the after-run, and obtains correction values based on the outputs from the detection sensors 54*a* and 54*b*, only when the environment is not a cold environment. This way, an inappropriate zero point adjustment can be reliably suppressed or reduced.

Further, the determination unit 91 determines whether the environment is a cold environment as follows. Only the temperature of cooling water whose heat capacity is large is used for determining whether the environment is not a cold environment or clearly a cold environment (step S101 and step S104). Next, the intake air temperature is used for determining whether the environment is a cold environment (step S105). With this, a highly reliable determination is achieved. Further, since the logic for determination becomes simple, the logic can be easily implemented even in a case where the program volume of the ECU 90 is limited.

In the present embodiment, if the environment is clearly not a cold environment based on the cooling water temperature Tw at the time of starting the engine, the correction values obtained from the detection sensors 54*a* and 54*b* at the site are used, instead of the past correction values stored in the storage unit 93 (step S201 to step S203). This way, a zero point adjustment that reflects a change occurring to the detection sensors 54*a* and 54*b* after the ECU 90 is powered off can be performed.

As hereinabove described, the correction values selected in step S203 or step S204 are each values resulting from subtracting the value of the atmospheric pressure detected by the atmospheric pressure sensor 73 from the values indicated by the electric signals output from the two detection sensors 54*a* and 54*b* under the atmospheric pressure. Therefore, when the correction values largely deviate from zero, the detection sensors 54*a* and 54*b* are likely to have an abnormality. In such a case, the ECU 90 generates a correction value abnormality alarm and restricts the rotation and the like of the internal combustion engine 100.

As described, the present embodiment can suppress or reduce obtaining of the correction values while the detection sensors 54*a* and 54*b* are frozen. Generating of the correction value abnormality alarm at the time of starting the internal combustion engine 100 can be suppressed or reduced, and the convenience of the internal combustion engine 100 can be improved.

As hereinabove described, an ECU 90 of the present embodiment for an internal combustion engine 100 performs zero point adjustment to detection values from detection sensors 54*a* and 54*b* of an EGR differential pressure sensor 54 provided to the internal combustion engine 100, while the internal combustion engine 100 operates. The ECU 90 of the internal combustion engine includes a cooling water temperature sensor 72, an intake air temperature sensor 71, a storage unit 93, a determination unit 91, and a zero point adjustment unit 92. The cooling water temperature sensor 72 is configured to detect a cooling water temperature Tw of the internal combustion engine 100. The intake air temperature sensor 71 is configured to detect an intake air temperature Ta of the internal combustion engine 100. The storage unit 93 stores correction values for calibrating detection values from the detection sensors 54*a* and 54*b*. The determination unit 91 determines whether an environment is a cold environment in which the EGR differential pressure sensor 54 is likely to freeze. The zero point correction unit 92 obtains the correction values. In an after-run control performed after the internal combustion engine 100 stops, the determination unit 91 compares a cooling water temperature Tw detected by the cooling water temperature sensor 72 with a first threshold value T1 (step S101) and determines that the environment is not the cold environment if the cooling water temperature Tw is equal to or higher than the first threshold value T1. If, as a result of the above determination, the cooling water temperature Tw detected by the cooling water temperature sensor 72 is less than the first threshold value T1; the determination unit 91 determines that the environment is not the cold environment if the cooling water temperature Tw is equal to or higher than a second threshold value T2 lower than the first threshold value T1 (step S104) and the intake air temperature Ta is equal to or higher than a third threshold value T3 (step S105), and otherwise, determines that the environment is the cold environment. The zero point adjustment unit 92 obtains correction values indicated by the detection sensors 54*a* and 54*b* when the determination unit 91 determines that the environment is not the cold environment (step S102). The storage unit 93 stores the correction values obtained by the zero point correction unit 92 (step S103).

With this, the correction values for the detection sensors 54*a* and 54*b* can be obtained immediately after the internal combustion engine 100 stops, in a situation where freezing of the detection sensors 54*a* and 54*b* is highly unlikely. On the other hand, for example, when the internal combustion engine 100 is stopped very soon after it is started, there is a possibility of the detection sensors 54*a* and 54*b* being frozen. Therefore, by determining whether or not the environment is a cold environment, obtaining of the correction values while the detection sensors 54*a* and 54*b* are frozen can be suppressed or reduced. Further, the process of comparing the cooling water temperature Tw with the threshold value T1 is performed in advance, the process of determining whether the environment is a cold environment is simplified. Therefore, sufficiency in the frequency of obtaining the correction values can be achieved.

Further, in the ECU 90 of the internal combustion engine 100 of the present embodiment, when the cooling water temperature Tw detected by the cooling water temperature sensor 72 within a period after powering on and before start of the internal combustion engine 100 is equal to or higher than a fourth threshold value T4, the zero point adjustment unit 92 obtains the correction values indicated by electric signals from the detection sensors 54*a* and 54*b*, and uses the correction values thus obtained to perform zero point adjustment of detection values of the detection sensors 54*a* and 54*b* after the internal combustion engine 100 is started (step S201 to step S203). When the cooling water temperature Tw is less than the fourth threshold value T4, the zero point adjustment unit 92 uses the correction values stored in the storage unit 93 to perform zero point adjustment of the detection values of the EGR differential pressure sensor 54 after powering on of the internal combustion engine 100 (step S204).

With this, when it is clearly determined that no freezing is taking place in the detection sensors 54*a* and 54*b*, the correction values obtained at the site by using the detection sensors 54*a* and 54*b* can be used in zero point adjustment, reflecting the current status of the detection sensors 54*a* and 54*b*. If this is not the case, the correction values stored in the storage unit 93 is used, so that zero point adjustment while freezing is taking place can be avoided.

Although a preferred embodiment of the present invention has been described above, the above-described configuration can be modified, for example, as follows.

The above embodiment deals with a case where the correction value is obtained and stored during the after-run, for each of the two detection sensors 54*a* and 54*b*. However, since it is the exhaust side detection sensor 54*a* in which freezing is likely to take place, a correction value may be obtained and stored during the after-run only for the exhaust side detection sensor 54*a*.

The storage unit 93 may store correction values having been obtained by the correction value obtaining unit 95 through a multiple number of times. This number of times can be suitably set within a range of, for example, twice or more but not more than ten times. In this case, for example, if the correction values obtained in step S204 of FIG. 4 largely deviate from zero, the correction values previously stored can be retrieved and used.

In the preparation process for starting the internal combustion engine 100, the determinations similar to those of step S101, step S104, step S105 in FIG. 3 may be performed instead of the determination in step S201 of FIG. 4.

The above-configuration may be adopted for zero point adjustment of a pressure sensor other than the detection sensors 54*a* and 54*b* of the EGR differential pressure sensor 54.

The processes shown in the flowcharts of the above description are no more than examples. The steps in the processes may be partially modified or deleted, or two or more steps may be executed in parallel, or another process may be added.

The above embodiment deals with a four cylinder internal combustion engine 100 as shown in FIG. 1. However, the number of cylinders may be a number other than four.

REFERENCE SIGNS LIST

71 intake air temperature sensor
72 cooling water temperature sensor
90 ECU
91 determination unit
92 zero point adjustment unit (calibration unit)
93 storage unit
100 internal combustion engine
Tw cooling water temperature
Ta intake air temperature
T1 first threshold value
T2 second threshold value
T3 third threshold value

The invention claimed is:

1. A control device for an internal combustion engine configured to calibrate a detected value from a pressure detection unit of the internal combustion engine, during operation of the internal combustion engine, the device comprising:

a cooling water temperature detection unit configured to detect a cooling water temperature of the internal combustion engine;

an intake air temperature detection unit configured to detect an intake air temperature of the internal combustion engine;

a storage unit configured to store a calibration reference value for calibrating the detection value from the pressure detection unit;

a determination unit configured to determine whether an environment is a cold environment in which the pressure detection unit is likely to freeze; and a calibration unit configured to obtain the calibration reference value, wherein in an after-run control performed after the internal combustion engine stops, the determination unit compares a cooling water temperature detected by the cooling water temperature detection unit with a first threshold value and determines that the environment is not the cold environment if the cooling water temperature is equal to or higher than the first threshold, if, as a result of the comparison, the cooling water temperature detected by the cooling water temperature detection unit is less than the first threshold value; the determination unit determines that the environment is not the cold environment if the cooling water temperature is equal to or higher than a second threshold value lower than the first threshold value and the intake air temperature is equal to or higher than a third threshold value, and otherwise, determines that the environment is the cold environment, the calibration unit obtains a calibration reference value based on the detection value from the pressure detection unit when the determination unit determines that the environment is not the cold environment, and the storage unit stores the calibration reference value obtained by the calibration unit.

2. The control device for the internal combustion engine according to claim 1, wherein if the cooling water temperature detected by the cooling water temperature detection unit is equal to or higher than a fourth threshold value within a period after powering on and before start of the internal combustion engine, the calibration unit obtains the calibration reference value based on a detection value detected by the pressure detection unit within the period after powering on and before start of the internal combustion engine, and uses the calibration reference value thus obtained to calibrate detection values of the pressure detection unit after start of the internal combustion engine, and if the cooling water temperature is less than the fourth threshold value within the period after powering on and before start of the internal combustion engine, the calibration unit uses the calibration reference value stored in the storage unit, to calibrate detection values of the pressure detection unit after start of the internal combustion engine.

* * * * *